United States Patent [19]

Ragen et al.

[11] Patent Number: 4,893,950

[45] Date of Patent: Jan. 16, 1990

[54] APPARATUS AND METHOD FOR CONTROLLING THE POSITIONING OF MARKING ELEMENTS IN A SERIAL IMPACT PRINTER

[75] Inventors: Robert A. Ragen, Hayward; Andrew Gabor, Alamo; Ivor Weller, Castro Valley; Michiel Frankhuizen, Martinez; Brian E. Jagger, Pleasanton, all of Calif.

[73] Assignee: Xerox Corporation, Stamford, Conn.

[21] Appl. No.: 250,798

[22] Filed: Sep. 28, 1988

[51] Int. Cl.[4] ..... B41J 1/30

[52] U.S. Cl. ..... 400/185; 400/55; 400/144.2; 400/212

[58] Field of Search ..... 400/55, 56, 57, 58, 400/59, 60, 185, 187, 212, 214, 697, 697.1

[56] References Cited

U.S. PATENT DOCUMENTS

| | | | |
|---|---|---|---|
| 4,227,819 | 10/1980 | Manriquez | 400/56 |
| 4,233,895 | 11/1980 | Wehler | 101/93.05 |
| 4,268,177 | 5/1981 | Veale | 400/55 |
| 4,365,900 | 12/1982 | Gottsmann | 400/57 |
| 4,384,794 | 5/1983 | Okano et al. | 400/56 |
| 4,439,051 | 3/1984 | Lawter | 400/605 |
| 4,472,073 | 9/1984 | Valle et al. | 400/185 |
| 4,514,101 | 4/1985 | Smith | 400/59 |
| 4,533,267 | 8/1985 | Kurachi et al. | 400/214 |
| 4,575,267 | 3/1986 | Brull | 400/56 |
| 4,589,788 | 5/1986 | Lendl | 400/187 |
| 4,609,294 | 9/1986 | Gomoll et al. | 40/59 |
| 4,613,248 | 9/1986 | Iwase et al. | 400/697.1 |
| 4,637,744 | 1/1987 | Valle et al. | 400/185 |
| 4,676,675 | 6/1987 | Suzuki et al. | 400/56 |
| 4,810,110 | 3/1989 | Myers | 400/185 |

FOREIGN PATENT DOCUMENTS

| | | | |
|---|---|---|---|
| 2919209 | 11/1980 | Fed. Rep. of Germany | 400/214 |
| 2067472 | 7/1982 | United Kingdom | 400/697.1 |

*Primary Examiner*—David A. Wiecking
*Attorney, Agent, or Firm*—Serge Abend

[57] ABSTRACT

A serial impact printer and including a single cam member for properly establishing and maintaining the throat gap distance between a character imprinting surface and the platen at a print point and for raising and lowering a selected ribbon, of a composite marking correcting ribbon pack assembly, to and from the print point. A short throat gap distance is needed for commercially acceptable printing speeds in this hammer mass printer, and is needed for high quality printing; conversely, a long throat gap distance is needed for print point visibility at all other times. The cam member has plural camming surfaces which coordinate ribbon position with throat gap distance.

9 Claims, 7 Drawing Sheets

APPARATUS AND METHOD FOR CONTROLLING THE POSITIONING OF MARKING ELEMENTS IN A SERIAL IMPACT PRINTER

FIELD OF THE INVENTION

This invention relates to a serial impact printer and, more particularly, to a single control member for properly establishing and maintaining the throat gap distance between the character surface and the platen and for raising and lowering of a composite marking/correcting ribbon pack. We provide the close throat gap needed for high quality printing at reasonable speeds, in this quiet printer, and the large gap needed for print point visibility at all other times. This invention also enables accurate establishment of the home position for the control member in an extremely low cost manner.

BACKGROUND OF THE INVENTION

The office has, for many years, been a stressful environment due, in part, to the large number of objectionable noise generators, such as typewriters, high speed impact printers, paper shredders, and other office machinery. Where several such devices are placed together in a single room, the cumulative noise pollution may even be hazardous to the health and well being of its occupants. The situation is well recognized and has been addressed by governmental bodies who have set standards for maximum acceptable noise levels in office environments. Attempts have been made by the technical community to reduce the noise pollution. Some of these methods include enclosing impact printers in sound attenuating covers, designing impact printers in which the impact noise is reduced, and designing quieter printers based on non-impact technologies such as ink jet and thermal transfer.

Noise measurements are often referenced as dBA values. The "A"scale, by which the sound values have been identified, represents humanly perceived levels of loudness as opposed to absolute values of sound intensity. When considering sound energy represented in dB (or dBA) units, it should be borne in mind that the scale is logarithmic and that a 10 dB difference means a factor of 10, a 20 dB difference means a factor of 100, 30 dB a factor of 1000, and so on.

Typically, impact printers generate impact noise in the range of 65 to just over 80 dBA, which is deemed to be intrusive. When reduced to the high 50s dBA, the noise is construed to be objectionable or annoying. It would be highly desirable to reduce the impact noise to a dBA value in the vicinity of 50 dBA. For example, the IBM Selectric ball unit typewriters generate about 78 dBA, while the Xerox Memorywriter typewriters generate about 68 dBA. The typewriter of the present invention has been typically measured at slightly less than 52 dBA. This represents a dramatic improvement on the order of about 100 times less noisy than present day offices, a notable achievement toward a less stressful office environment.

Although the printing impact, produced as the hammer impacts and drives the type character pad against the ribbon, the print sheet and the platen with sufficient force to release the ink from the ribbon, is the major source of noise in the typewriter, other noise sources are present. In the presently available typewriters, the impact noise overshadows the other noises. But, once the impact noise has been substantially reduced, the other noises will no longer be extraneous. Thus, the design of a truly quiet printer requires the designer to address reducing all other noise sources, such as those arising from carriage motion, character selection, ribbon lift and advance, as well as from miscellaneous clutches, solenoids, motors and switches.

In conventional ballistic hammer impact printers a hammer mass of about 2.5 grams is driven ballistically by a solenoid-actuated clapper toward the ribbon/paper/platen combination. When the hammer hits the rear surface of the character pad it drives it against the ribbon/paper/platen combination and deforms the platen which, when it has absorbed the hammer impact energy, seeks to return to its normal shape by driving the hammer back to its home position where it must be stopped, usually by another impact. This series of impacts is the main source of the objectionable noise. Looking solely at the platen deformation impact portion of the hammer movement, the total dwell time is typically in the vicinity of 100 microseconds. At a printing speed of 30 characters per second, the mean time available between character impacts is about 30 milliseconds. The impact noise reduction achieved by the printing mechanism of the present typewriter is made possible by significantly stretching the impact dwell time to a substantially larger fraction of the printing cycle than is typical in conventional printers. For instance, if the dwell time were stretched from 100 microseconds to 6 to 10 milliseconds, this would represent a sixty- to one hundred-fold increase, or stretch, in pulse width relative to the conventional. By extending the deforming of the platen over a longer period of time, an attendant reduction in noise output can be achieved.

The general concept implemented in the present typewriter, i.e. reduction of impulse noise achieved by stretching the deformaton pulse, has been recognized for many decades. As long ago as 1918, in U.S. Pat. No. 1,261,751 (Anderson) it was recognized that quieter operation of the printing function in a typewriter may be achieved by increasing the "time actually used in making the impression". A type bar typewriter operating upon the principles described in this patent was commercially available at that time.

RELATED PATENTS AND PRIOR ART

The quiet impact printing mechanism incorporating the present invention is described, and its theory of operation is explained in the following commonly assigned patents any one of whose disclosures is herein fully incorporated by reference. U.S. Pat. No. 4,668,112 (Gabor et al.), entitled "Quiet Impact Printer", relates to the manner in which the impact force in a printer of this type is controlled; U.S. Pat. No. 4,673,305 (Crystal), entitled "Printwheel For Use in a Serial Printer", relates to a printwheel modified for quiet operation when used with an alignment member; U.S. Pat. No. 4,678,355 (Gabor et al.) entitled "Print Tip Contact Sensor for Quiet Compact Printer", relates to an impacting element having a sensor thereon for signaling initiation of impact; U.S. Pat. No. 4,681,469 (Gabor), entitled "Quiet Impact Printer", relates to the high mass, prolonged contact period, parameters of aprinter of this type; U.S. Pat. No. 4,686,900 (Crystal et al.), entitled "Impact Printer With Application of Oblique Print Force", relates to a shear inducing impacting element; and U.S. Pat. No. 4,737,043 (Gabor et al.), entitled "Impact Mechanism for Quiet Impact Printer", relates to a unique prime mover and high mass print tip driver.

It will become apparent from a review of the commonly assigned patents that a character impacting member, having a high effective mass, is driven with a first force, from a starting position to the rear of a character element and then together with the character imprinting element across a throat gap into incipient contact with the platen/paper combination. During its traverse of the throat gap, the character element picks up the marking (or correcting) ribbon and drives it against the platen/paper combination with a second force of a magnitude sufficient to release the marking material and deform the platen. Since the impacting member must have a very low terminal velocity at the instant of contact, it must be rapidly accelerated and decelerated across the throat gap distance. In order to achieve acceptable printing speeds, an extremely short throat distance is preferred.

Furthermore, it is imperative that the throat gap distance be accurately established and continuously maintained during printing despite thickness variations of the record medium and machine dimensional variations. Of course, it is to be understood that a short throat gap distance in any impact printer will allow faster printing speeds to be achieved.

The present control mechanism comprises a single cam mechanism for adjusting the throat gap and for raising and lowering the marking and correcting ribbons. Control cams for elevating an associated pair of marking and correcting ribbons are disclosed in each of U.S. Pat. Nos. 4,472,073 (Valle et al), 4,533,267 (Kurachi et al.), 4,589,788 (Lendl), 4,613,248 (Iwase et al) and 4,637,744 (Valle et al.). In each patent, one or more cam tracks is provided to raise a selected one of a pair of ribbons to a print line or to lower both ribbons to a neutral position for viewing the print line. A cam follower arm, depending from a pivotable platform upon which the ribbon housings are mounted, extends into the cam track so as to drive the platform and the housings in an arcuate path.

It is also well known to provide an apparatus for adjusting the gap between a printing platen and a marking device. Typical manually adjustable mechanisms are disclosed in each of U.S. Pat. Nos. 4,268,177 (Veale), 4,365,900 (Gottsmann et al), 4,384,794 (Okano et al) and 4,514,101 (Smith). Automatic paper thickness compensating mechanisms, wherein the platen is movable toward and away from the print head, are taught in each of U.S. Pat. Nos. 4,227,819 (Manriquez), 4,439,051 (Lawter) and 4,575,267 (Brull), while in 4,609,294 (Gomoll et al.) the carriage support rod, upon which the print head travels, may be cammed toward and away from the platen to establish the throat gap. In U.S. Pat. No. 4,233,895 (Wehler) a paper thickness compensating mechanism is disclosed which automatically adjusts the position of the printing head relative to the platen as a function of the thickness of the paper during printing, while the printing head is moved in the serial printing direction.

During operation of our printer, we are able to accomplish a combination of tasks with a single control mechanism. We are able to accurately locate the "home" position of our cam element, at which the throat gap distance is the largest (about 0.100 inch) and from which rotation thereof in either direction causes one of the ribbons to be elevated and the throat gap to be closed. Since the print point is visible at the "home" position, we return to this position a predetermined time after typing has ceased, in order to allow the operator to view the last typed characters. Also, it is easier to mount and remove the ribbon assembly when the throat gap is at its largest. When typing is to begin again, the appropriate ribbon is elevated and the small throat gap (about 0.050 inch) is reestablished so that high quality printing, at reasonable speeds, may be achieved. While printing is being conducted, the throat gap is continuously monitored in order that it can be increased to its optimal distance if it becomes too small due to encountering thicker record media or a misalignment of the platen or carriage rails. Modification of the throat gap distance during printing will not affect the print point location of the ribbon.

It is the primary object of this invention to provide a control mechanism for correlating the vertical positioning of each of the two ribbons (marking and correcting) with the throat gap distance in order to assure print line visibility when typing is interrupted, accurate reestablishment of the throat gap for printing and correcting, and non-interference of the ribbons with either the platen or the printwheel during upward and downward movement.

SUMMARY OF THE INVENTION

This object may be carried out, in one form, by providing a serial impact printer including a platen mounted for rotation about its axis, a scanning carriage mounted for movement along a path parallel to the platen axis and supporting thereon a character imprinting member, a ribbon pack assembly including a marking ribbon and a correcting ribbon disposed one above the other, and a hammer for impacting the character imprinting member. Our invention includes a control assembly comprising a unitary cam driven by a drive motor for raising and lowering the ribbon pack assembly and for moving the character imprinting member toward and away from the platen to vary a throat gap distance therebetween. A sensor is associated with the character imprinting member for generating a signal when the throat gap distance deviates from a predetermined reference distance, and a microprocessor is provided for receiving the sensor signals for controlling the energization of the drive motor in response thereto.

BRIEF DESCRIPTION OF THE DRAWINGS

Other objects and further features and advantages of this invention will be apparent from the following, more particular description considered together with the accompanying drawings, wherein.

DETAILED DESCRIPTION OF THE ILLUSTRATED EMBODIMENT

Figure 1:
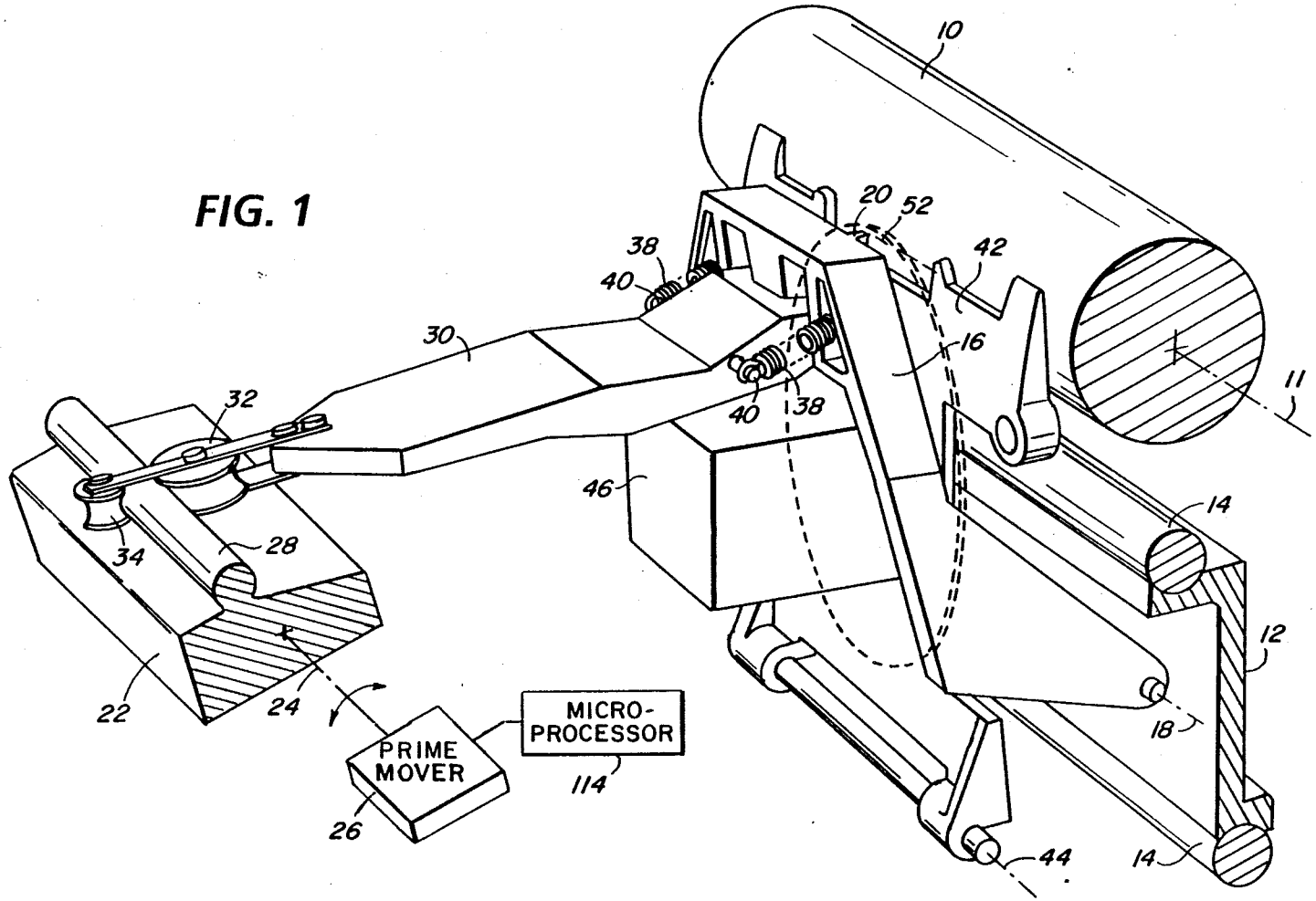
FIG. 1 is a partial perspective view schematically showing the relevant features of a quiet impact printer in which the present invention may be incorporated.

Salient features of the quiet impact printer, in which the present invention is incorporated, are shown in FIG. 1. These include a platen 10 suitably mounted on a frame (not shown) for rotation about its axis 11 to advance and retract a record carrier, comprising a single sheet or a multi-part form, on which characters may be imprinted. A carriage support beam 12 fitted with rod stock rails 14 spans the printer from side-to-side beneath and parallel to the platen for rigidly and smoothly supporting a carriage for traversing movement parallel to the axis of the platen. Secured upon the carriage, for traversing movement therewith, is a horseshoe-shaped interposer 16 mounted for arcuate movement about pivot axis 18 and carrying a print tip 20 at its apex.

A rockable bail bar 22 extends substantially parallel to the axis of platen 10 and is constrained to limited angular movement toward and away from the platen about its axis of rotation 24. Prime mover 26, in the form of a reciprocating voice coil motor, a rotary motor or any other suitable driver is connected to the bail bar for imparting the rocking movement thereto. A bead or rail 28 on the bail bar receives one end of push rod 30, via a pair of capturing rollers 32 and 34, for moving it toward and away from the platen as the bail bar is rocked. The non-collapsible push rod illustrated in FIG. 1 is a generic form of this element which is preferably collapsible for allowing the print tip 20 to be drawn back away from the platen in order to allow the operator easy access to a printwheel. A bearing surface 36 (shown in FIG. 2) on the opposite end of the push rod is biased into engagement with a seat on the rear wall of the print tip 20 by means of tension springs 38 extending between pins 40 on the push rod and suitable anchors (not shown) on the interposer 16. Thus, the drive force of the prime mover 26 is multiplied by the bail bar 22 and is translated to the print tip 20 by the push rod 30 which may pivot about its bearing surface 36, so as to enable it to follow the arcuate path prescribed by the pivoting interposer 16.

Figure 2:
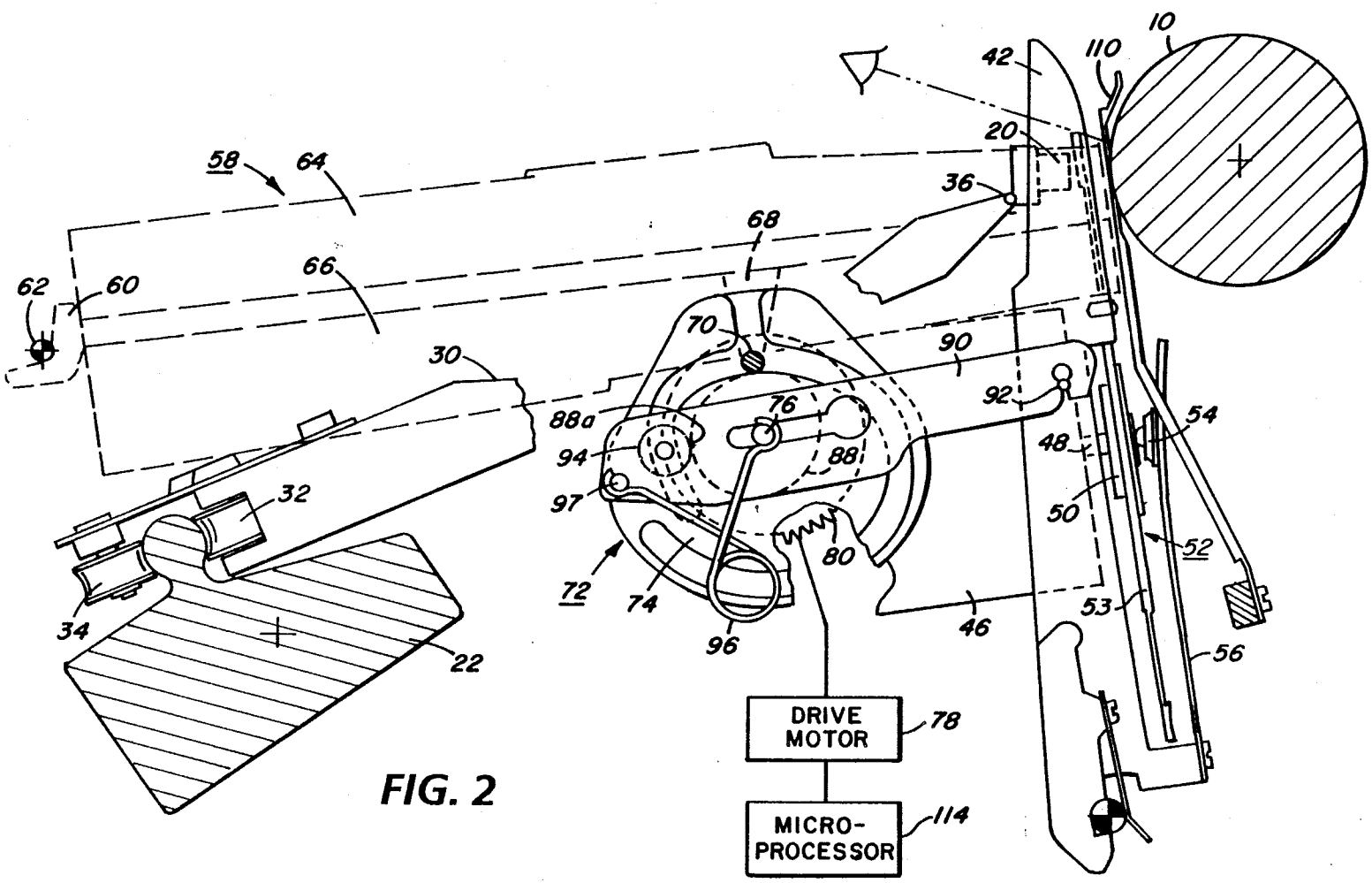
FIG. 2 is a side elevation view, taken from the right side of the printer, showing the home position of the printing elements.

Also pivotally mounted upon the carriage is a pivot frame 42, movable toward and away from the platen in an arcuate path about pivot axis 44. As best seen in FIG. 2, a printwheel drive motor 46, having a drive shaft 48 terminating in a drive coupling 50, is secured to the pivot frame for movement therewith. Printwheel 52, comprises a hub 53 from which radial spokes extend, each terminating in a character imprinting surface. When dropped into place, the hub is urged against the drive coupling by retainer button 54 on the end of retainer spring 56. By moving the pivot frame toward and away from the platen, the printwheel is moved relative to the platen and the throat gap distance, between the character imprinting face and the image receptor sheet on the platen, may be automatically controlled in a manner to be described.

A ribbon pack assembly 58 (shown in phantom lines) overlies the carriage and is mounted thereon by a pair of pivot lugs 60 underlying pivot pins 62 on the carriage. The ribbon pack assembly comprises an upper housing 64 containing a supply of marking ribbon and a lower housing 66 containing a supply of correcting ribbon. A coupling dagger arm 68 depending from the upper housing terminates in a cam follower pin 70. The overall plan profile of the ribbon pack assembly 58 is comparable to standard ribbon housings, in that it includes a body storage portion and a pair of dispensing horns between which the push rod 30 may pass to contact the print tip 20.

A throat adjust and ribbon lift control mechanism 72, includes a cam member 74 mounted for rotation upon the carriage about axis pin 76 and a stepper-type drive motor 78 coupled to a gear 80 on cam member 74, also mounted upon the carriage. The cam member comprises an entrance slot 82, for receiving cam follower pin 70, communicating with a short, marking cam track 84 and a long, correcting cam track 86, and a cam formation 88 extending axially outwardly from the member and surrounding the pin 76. Cam tracks 84 and 86 control ribbon elevation and cam formation 88 controls throat gap distance via throat adjusting link 90. One end of link 90 is connected to a pin 92 on the pivot frame 42 while the other end supports cam follower roller 94. A torsion spring 96, connected between axis pin 76 and pin 97 on link 90, serves to urge the cam follower roller into intimate contact with the cam formation 88 and to retain the link 90 in position adjacent the cam formation.

Figure 3:
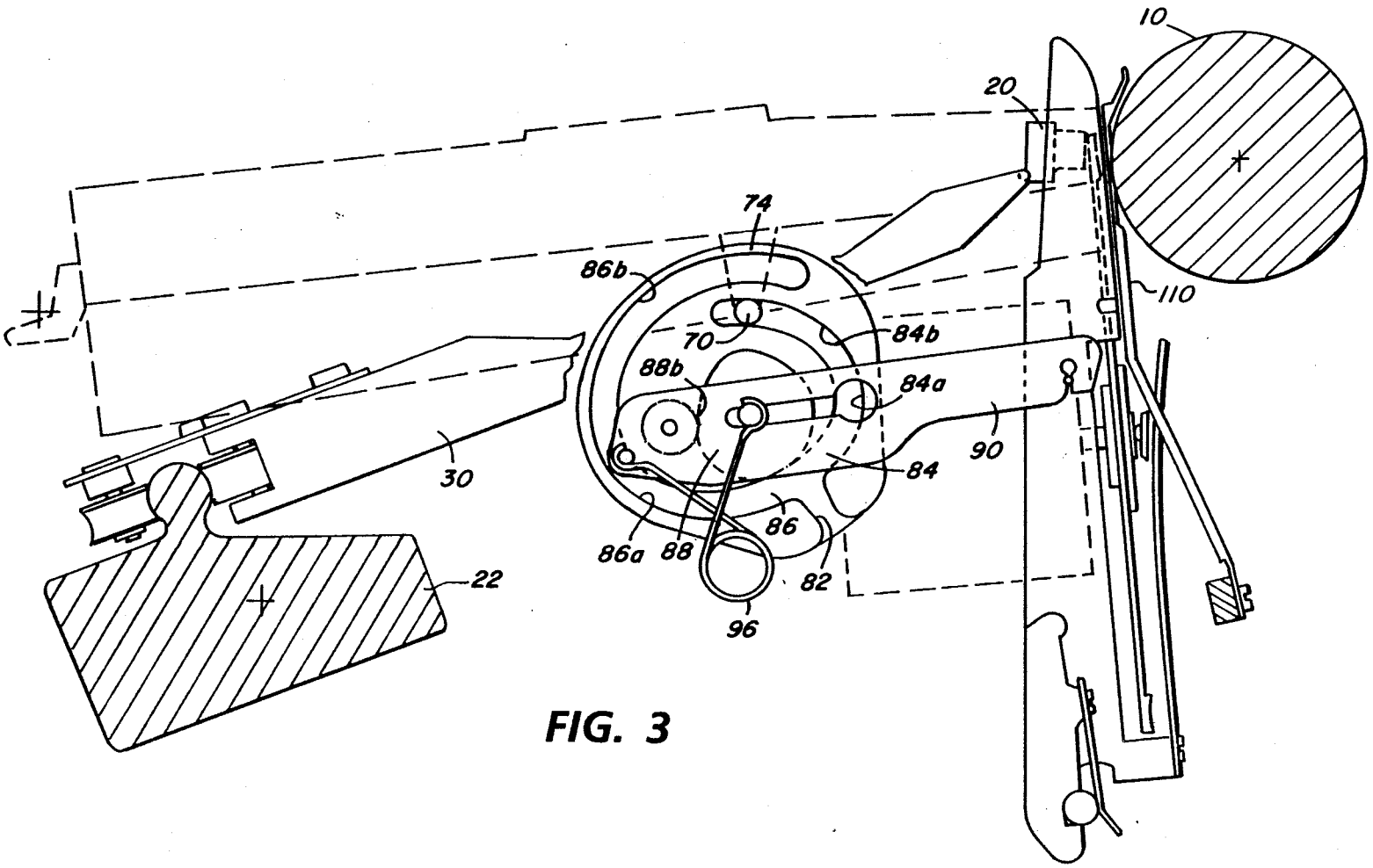
FIG. 3 is a side elevation view, similar to FIG. 2, showing the printing position of the printing elements.
Figure 4:
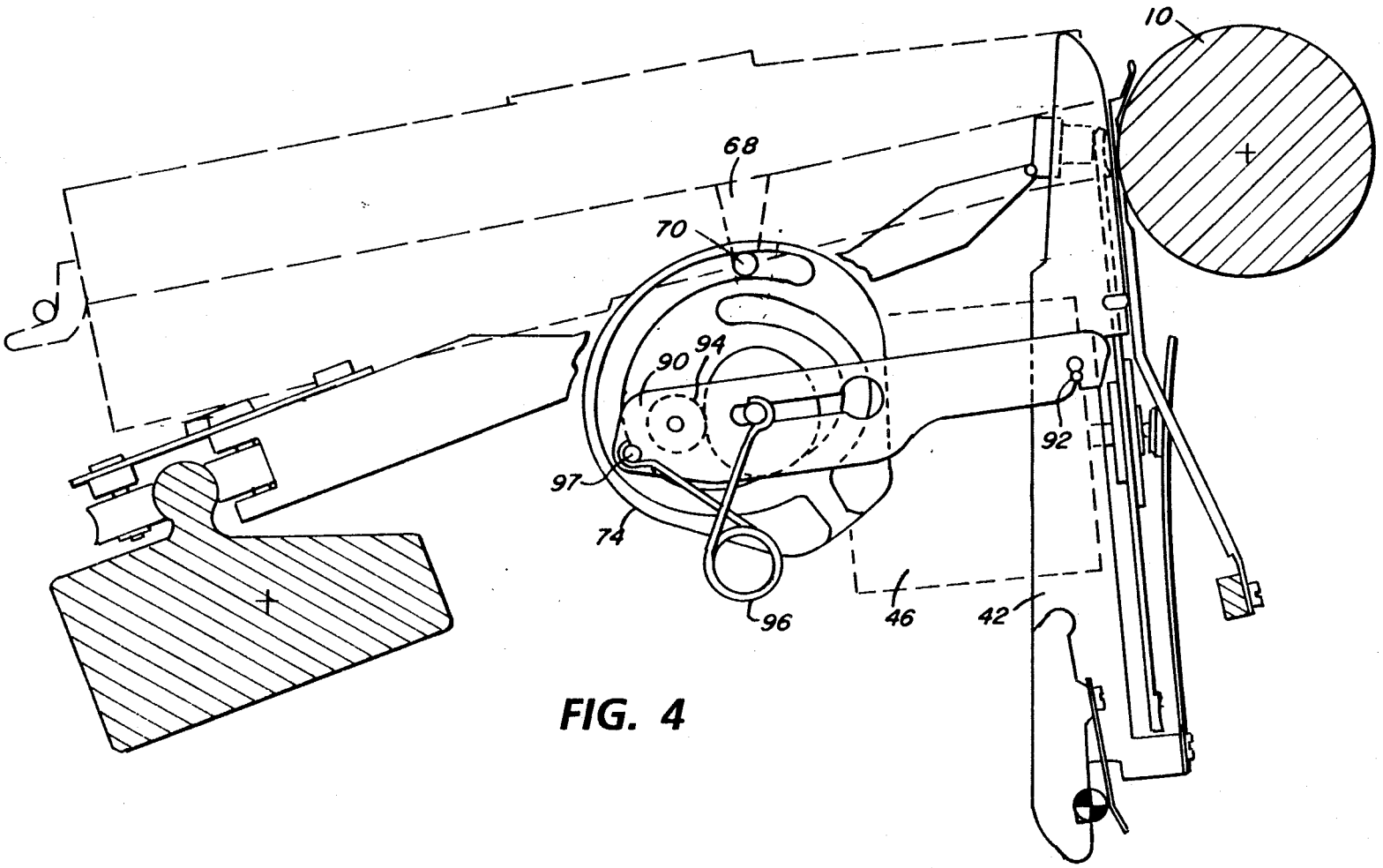
FIG. 4 is a side elevation view, similar to FIG. 2, showing the correcting position of the printing elements.

The profile of the cam formation 88 is such that cam follower roller 94 contacts its largest diameter portion **88*a* when the cam member 74 is in the "home position" orientation illustrated in FIG. 2 and the cam follower roller contacts its smallest diameter portion 88*b* when the cam member is in the orientation illustrated in FIGS. 3 and 4. Thus, as the cam member is rotated by motor 78, throat adjusting link 90 moves the pivot frame 42 and printwheel 52 from a rest position (FIG. 2) to a printing position (FIGS. 3 and 4). Simultaneously, the cam follower pin 70 moves along either cam track 84 or cam track 86 (depending on the direction of rotation of the cam member), each of which begins with a rise portion 84*a*/86*a* and terminates in a uniform diameter portion 84*b*/86*b*. Rotation of the cam member 74 in a clockwise direction moves the ribbon pack assembly 58 from a lowermost rest position (FIG. 2) to an intermediate, raised, marking position (FIG. 3). Rotation of the cam member 74 in a counterclockwise direction moves the ribbon pack assembly 58 from the lowermost rest position (FIG. 2) past the intermediate marking positionand, and then to an uppermost, correcting position (FIG. 4**).

Figure 5:
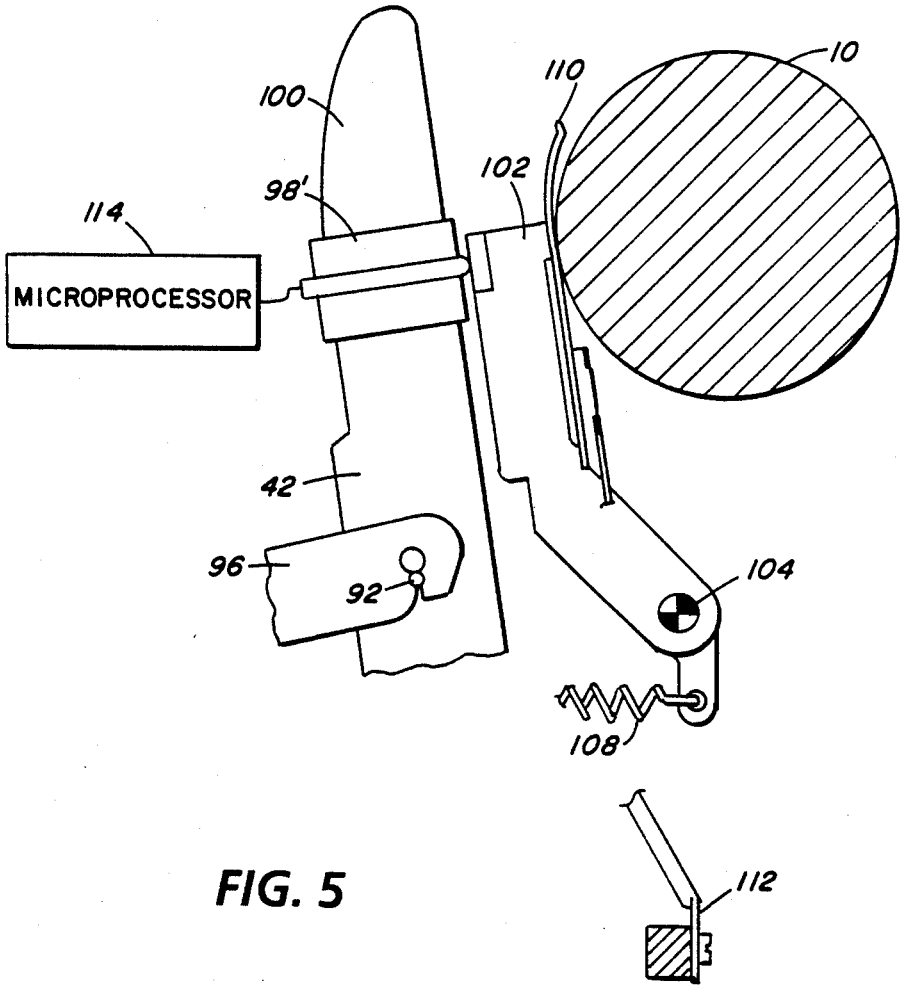
FIG. 5 is an enlarged partial side elevation view showing the throat sensing mechanism.
Figure 6:
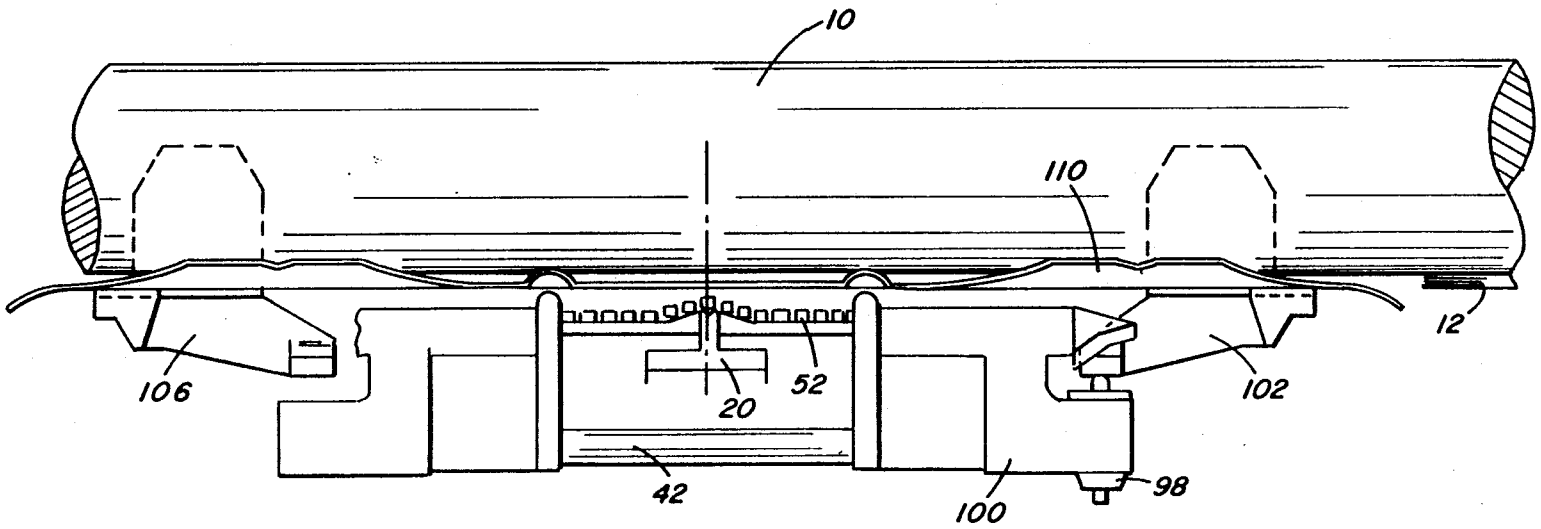
FIG. 6 is a partial plan view showing the throat sensing mechanism.

As illustrated in FIGS. 5 and 6, the pivot frame is provided with a throat switch 98, mounted upon right side extension 100, which is actuated by a right side throat adjust paddle 102, mounted for arcuate movement about one end of carriage-mounted pivot axle 104. A similar throat adjust paddle 106 is located at the left side of pivot axle 104 so that movement of either paddle may actuate the switch. A spring 108 biases the paddle assembly against a flexible, spring stock, card guide 110 secured to the carriage at its lower end 112 and lightly biased against the platen 10. Any movement of the card guide away from the platen will move the appropriate throat adjust paddle and, if large enough, will transition the switch (from open to closed, or vice versa), sending a signal to the microprocessor 114 which controls the drive motor 78. We use a normally closed switch, which is opened by the throat adjust paddle, for failsafe purposes. In response to various input signals, the microprocessor controls the movements of prime mover 26, stepper drive motor 78, a ribbon advance motor, and other motors.

When our impact printer is powered-up, an initialization sequence is conducted in order to determine the true "home position" of the cam member 74 (as opposed to the virtual home position where the cam follower pin 70 enters the entrance slot 82) from which rotation of the cam, in either direction, begins to lift one of the ribbons. Our invention allows us to achieve a precise step count for the "home position" relative to the true location of the platen, within a single motor step of 0.0025 inch, without the need for ultra precise tolerances in the machine parts or precisely located switches, which drive up the manufacturing costs. First, the drive motor 78 is energized to drive the cam member incrementally in one direction, counting the steps until a signal has been received that the throat switch 98 is transitionned. Then, the drive motor 78 is reversed to drive the cam member incrementally in the opposite direction, counting the steps until a second switch transition signal is received. The count of the total number of stepper motor steps from the first switch transition to the second switch transition represents the total rotary travel of the cam member from the platen, in one direction, back to the platen, in the opposite direction. Based upon this count between the two end points, the microprocessor 114 calculates the "home position", which will be a function of the ratio of tthe lengths of the cam tracks 84 and 86.

Figure 7:
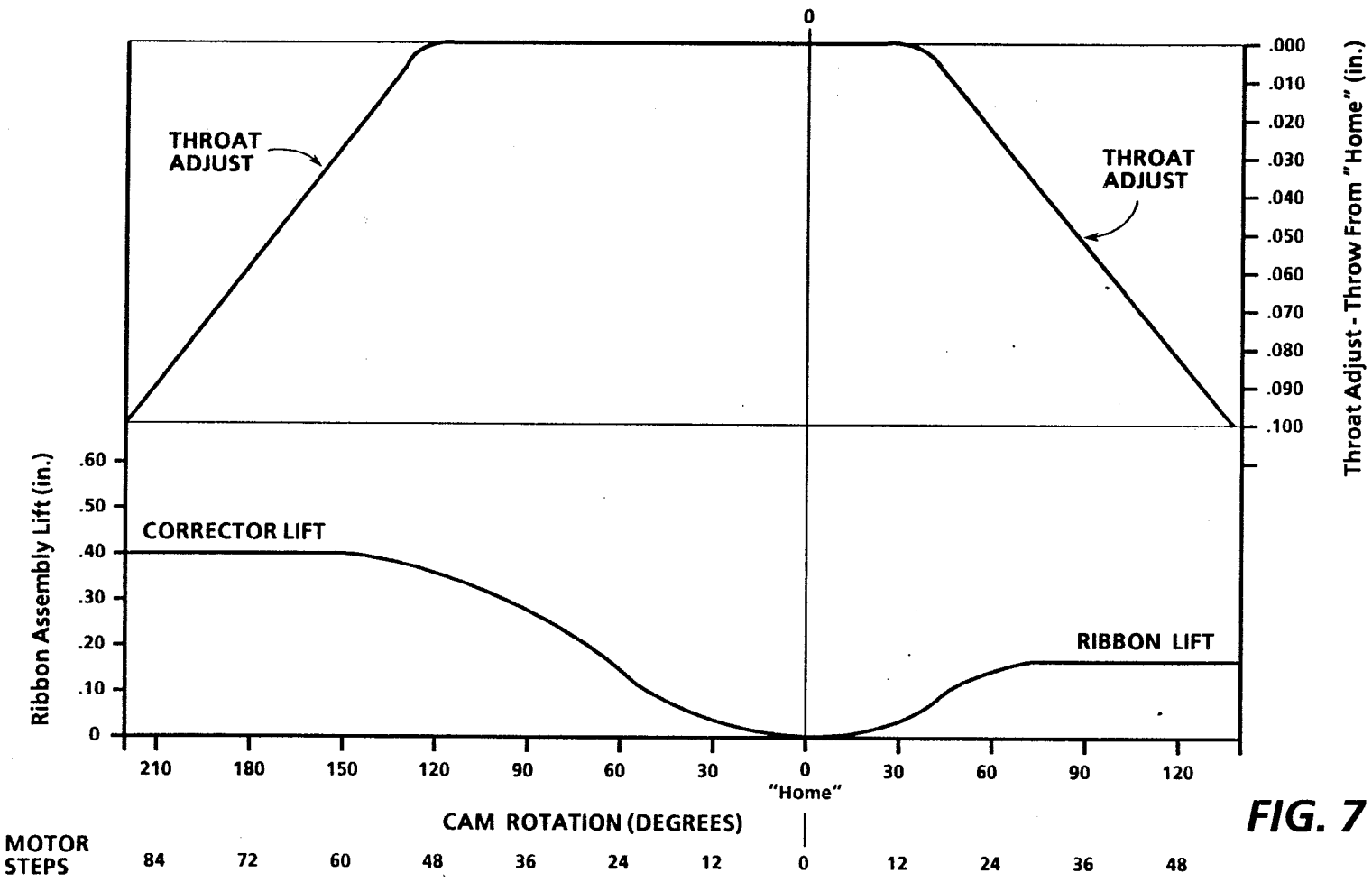
FIG. 7 is a graphical representation of the ribbon assembly lift and throat adjust cam profiles.

More specifically, considering the cam profile diagram of FIG. 7, it can be seen that since the correction ribbon must be lifted approximately twice the distance (about 0.38 inch) that the marking ribbon must be lifted (about 0.17 inch), and requires an arc of about 220° to the print point for cam track 86 versus an arc of about 140° to the print point for cam track 84. Thus, the ratio of the cam lengths is about 60:40. During initialization, we first rotate the cam member in a counterclockwise direction (as viewed from the right side of the printer) to a first switch transition, wherein cam follower pin 70 moves in longer cam track 86. Then we rotate it in a clockwise direction until a second switch transition is effected, near the end of shorter cam track 84; a total count between transitions of about 140 steps. A computation precisely determines the "home" position of the cam member at 56 steps back from the second switch transition; i.e. 140 steps between switch transitions, multiplied by 0.4. This method will be absolutely accurate, regardless of how sloppy the throat switch 98 may be, since the same switch conditions give rise to the end point transitions. Additionally, the number of steps to a "printing position" and a "correcting position" are computed to be two steps (about 0.005 inch) back from the throat switch transition locations, a distance of about 0.050 inch.

Whenever typing is stopped, or the operator pauses beyond a predetermined delay time, the microprocessor controls the various mechanisms to drive each to a "home position" where print point visibility is at a maximum. At that stand-by location the cam member 74 draws back the pivot frame to a throat gap of about 0.100 inch, the cam member lowers the ribbon pack assembly 58 to the FIG. 2 position, the printwheel 52 is rotated to a position where a gap is present between character imprinting surfaces, and the bail bar is rocked back to draw the print tip away from the platen. When the operator resumes typing, the mechanisms advance these elements to their "printing position".

During printing, as the carriage traverses the platen, the throat gap may diminish if the card guide 110 is moved away from the platen by an increase in paper thickness (e.g. six-part form on the right and one-part on the left) or a skewing of the platen or carriage rails. Then the throat adjust paddle 102 will actuate throat switch 98 and cause a switch transition. Upon receiving a transition signal, the microprocessor will incrementally energize the drive motor 78 to draw back the pivot frame until another transition occurs and then take a further two steps back in order to return the throat gap to 0.050 inch. This new print position is sent to the microprocessor so that it may be reestablished when returning from the "home position" after a long pause or cessation of typing. The above-described throat gap correction procedure takes place without affecting ribbon height since the tracks 84 and 86 maintain a constant diameter dwell subsequent to their initial rise.

Prior to effecting long, fast traverses it is desirable to provide a little more clearance. Thus, when a carriage return or a long tab is instructed, the throat gap is programmed to be increased by about 0.025 inch, in case there are tears or folds in the paper, or paper clips, staples or other obstructions which could damage the printing mechanism. After the traverse, the pivot frame is returned by the same amount that it was backed out while watching for switch transitions, so that corrections can be made for any changes in clearance.

We do not rely upon the initialized throat gap distance, and corrections thereto, for the entire run of the printer. It is our intent to reset the gap for every fresh sheet of record carrier because, in our system, the throat gap is adjusted to compensate only for interfering objects which require a larger gap, but not vice versa. Thus, if a first record carrier is a six-part form andthe next is a single sheet, there would be an extra 0.025 inch clearance in the throat gap and the adjustment algorithm will not make the necessary correction. Since introducing a new sheet to its printing position requires about a sixteen line (about 3 inch) advance during which no characters are printed, our system will automatically reinitialize the printer to establish a new "home position" after every such advance, regardless of whether it is predicated on the introduction of a new sheet.

Our invention enables our high hammer mass printer to operate at commercially reasonable speeds and to achieve high quality output. These are possible because the throat gap is kept small and because the throat gap is uniformly maintained so that the character impacts at the proper angle, optimizing deflection of the character beam and insuring that the surface of the character is tangent to the platen at impact, virtually at all times.

It should be understood that the present disclosure has been made only by way of example and that numerous changes in details of construction and the combination and arrangement of parts may be resorted to without departing from the true spirit and scope of the invention as hereinafter claimed.

What is claimed:

1. A serial impact printer including a platen mounted for rotation about its axis, a scanning carriage mounted for movement along a path parallel to said axis and supporting thereon character imprinting means, a ribbon assembly including a marking ribbon and a correcting ribbon disposed one above the other, and hammer means for impacting said character imprinting means, said printer being characterized by marking element position control means comprising a unitary cam for raising and lowering said ribbon assembly and for moving said character imprinting means toward and away from said platen to vary a throat gap distance therebetween, drive means for rotating said cam means, sensor means for generating a signal when said throat gap distance deviates from a predetermined reference distance, and computing means for receiving said signal and for controlling the energization of said drive means in response thereto.

2. The serial impact printer as defined in claim 1 characterized in that said unitary cam includes an entrance slot communicating with a first and second cam track, and a cam follower pin connected to said ribbon assembly, said cam tracks being located relative to said entrance slot such that rotation of said cam in one direction causes said cam follower pin to move in said first cam track and rotation of said cam in the opposite direction causes said cam follower pin to move in said second cam track.

3. The serial impact printer as defined in claim 2 characterized in that said one cam track has a low rise portion and a first dwell portion for locating said marking ribbon at a print point on said platen, and said other cam track has a high rise portion and a second dwell portion for locating said correcting ribbon at said print point.

4. The serial impact printer as defined in claim 3 characterized in that said first dwell portion has a smaller diameter than said second dwell portion.

5. The serial impact printer as defined in any one of claims 1 to 4 characterized in that said unitary cam further includes a central, axially extending, cam formation for establishing the throat gap distance in conjunction with connecting means extending between said character imprinting means and said cam formation.

6. The serial impact printer as defined in claim 4 characterized in that said unitary cam further includes a central, axially extending, cam formation for establishing the throat gap distance in conjunction with connecting means extending between said character imprinting means and said cam formation, and said cam track rise portions extend radially outwardly of a cam formation dwell portion while said cam track dwell portions extend radially outwardly of a cam formation throw portion, whereby variations may be effected in said throat gap distance by small rotary movements of said cam without affecting ribbon height.

7. The serial impact printer as defined in any one of claims 1 to 4 and 6 further characterized by a card guide supported upon said carriage and biased against said platen, and sensor actuating means biased against said card guide so as to be movable toward and away from said platen by said card guide.

8. In a serial impact printer comprising a platen rotatable about its axis, a scanning carriage movable along a path parallel to said axis and supporting thereon character imprinting means, a ribbon assembly including a marking ribbon and a correcting ribbon disposed one above the other, hammer means movable for impacting said character imprinting means, a unitary cam movable for raising and lowering said ribbon assembly and for moving said character imprinting means toward and away from said platen to vary a throat gap distance therebetween, and a drive motor for rotating said unitary cam, a method for determining the home position of said ribbon assembly and said character imprinting means relative to said platen for achieving enhanced print point visibility, said method comprising the steps of energizing said drive motor for rotating said cam in a first direction so that said cam elevates one of said ribbons to said print point and moves said character imprinting means toward said platen, sensing a first signal indicative of said character imprinting means being a predetermined distance from said platen, reversing said drive motor for rotating said cam in the opposite direction, in response to said first signal, so that said one of said ribbons is lowered and then the other of said ribbons is elevated to said print point while simultaneously said character imprinting means is moved away from said platen and then is moved toward said platen, sensing a second signal indicative of said character imprinting means being a predetermined distance from said platen, and computing the location of said home position as a function of the ratio of the lengths of the angular paths required to raise each of said ribbons to said print point.

9. In a serial impact printer comprising a platen rotatable about its axis, a scanning carriage movable along a path parallel to said axis and supporting thereon character imprinting means, a ribbon assembly including a marking ribbon and a correcting ribbon disposed one above the other, hammer means movable for impacting said character imprinting means, a unitary cam movable for raising and lowering said ribbon assembly and for moving said character imprinting means toward and away from said platen to vary a throat gap distance therebetween, and a drive motor for rotating said unitary cam, a method for maintaining said character imprinting means at a predetermined throat gap distance characterized by comprising the steps of:

sensing when said throat gap distance diminishes from said predetermined distance as said carriage traverses said platen, generating a signal responsive to the occurrence of said diminution, and energizing said drive motor in response to said signal for rotating said cam so as to move said character imprinting means away from said platen without affecting the ribbon height.

* * * * *